US009923282B2

(12) United States Patent
Lai et al.

(10) Patent No.: US 9,923,282 B2
(45) Date of Patent: Mar. 20, 2018

(54) SYSTEM AND METHOD FOR A MOBILE ANTENNA WITH ADJUSTABLE RESONANT FREQUENCIES AND RADIATION PATTERN

(71) Applicant: FutureWei Technologies, Inc., Plano, TX (US)

(72) Inventors: Chun Kit Lai, La Jolla, CA (US); Wee Kian Toh, San Diego, CA (US); Ning Ma, San Diego, CA (US)

(73) Assignee: Futurewei Technologies, Inc., Plano, TX (US)

( * ) Notice: Subject to any disclaimer, the term of this patent is extended or adjusted under 35 U.S.C. 154(b) by 239 days.

(21) Appl. No.: 13/971,628

(22) Filed: Aug. 20, 2013

(65) Prior Publication Data

US 2015/0054711 A1 Feb. 26, 2015

(51) Int. Cl.
*H01Q 3/24* (2006.01)
*H01Q 21/30* (2006.01)
(Continued)

(52) U.S. Cl.
CPC ..... *H01Q 21/30* (2013.01); *H01Q 1/243* (2013.01); *H01Q 1/38* (2013.01); *H01Q 3/24* (2013.01);
(Continued)

(58) Field of Classification Search
CPC ..... H01Q 21/30; H01Q 3/24; H01Q 5/49; H01Q 3/2623; H01Q 5/371; H01Q 5/378;
(Continued)

(56) References Cited

U.S. PATENT DOCUMENTS 7,079,079 B2 * 7/2006 Jo ..... H01Q 1/243 343/700 MS
7,701,401 B2 * 4/2010 Suzuki ..... H01Q 1/242 343/702
(Continued)

FOREIGN PATENT DOCUMENTS

CN 101562273 A 10/2009
CN 101562274 A 10/2009
(Continued)

OTHER PUBLICATIONS

Yang, F., et al., "Novel reconfigurable multi-band antennas for multi-radio platforms," Radio and Wireless Symposium, IEEE. Jan. 22-24, 2008, pp. 723-726. doi: 10.1109/RWS.2008.4463594.
(Continued)

*Primary Examiner* — Dameon E Levi
*Assistant Examiner* — Hasan Islam
(74) *Attorney, Agent, or Firm* — Slater Matsil, LLP

(57) ABSTRACT

Embodiments are provided for an efficient antenna design and operation method to adjust or add frequency bands at mobile devices using the available limited antenna size. The embodiments include electrically coupling to the antenna elements at a mobile or radio device a tuning stub or element through a printed circuit board (PCB) or a metal chassis. The PCB is placed between the antenna elements and the tuning stub and is connected to the antenna elements. The tuning stub, e.g., at a corner of the PCB, is connected or disconnected via a switch from the PCB, and hence the antenna elements, to shift the radiation of the antenna at different frequencies and also provide an additional mode of radiation. The tuning stub can also be switched to vary the radiation pattern of the antenna.

23 Claims, 4 Drawing Sheets

(51) Int. Cl.

| | |
|---|---|
| ***H01Q 1/24*** | (2006.01) |
| ***H01Q 1/38*** | (2006.01) |
| ***H01Q 9/42*** | (2006.01) |
| ***H01Q 21/28*** | (2006.01) |
| ***H01Q 5/378*** | (2015.01) |
| ***H01Q 9/04*** | (2006.01) |
| ***H01Q 21/29*** | (2006.01) |

(52) U.S. Cl.
CPC ..... *H01Q 5/378* (2015.01); *H01Q 9/0442* (2013.01); *H01Q 9/42* (2013.01); *H01Q 21/28* (2013.01); *H01Q 21/29* (2013.01)

(58) Field of Classification Search
CPC ..... H01Q 9/30; H01Q 1/50; H01Q 5/328; H01Q 5/342; H01Q 9/42
USPC ..... 343/876, 702, 846
See application file for complete search history.

(56) References Cited

U.S. PATENT DOCUMENTS

| | | | | |
|---|---|---|---|---|
| 8,648,756 | B1 * | 2/2014 | Desclos | H01Q 5/335 343/702 |
| 8,659,488 | B2 * | 2/2014 | Tsai | H01Q 1/48 343/702 |
| 2001/0043159 | A1 | 11/2001 | Masuda et al. | |
| 2007/0188388 | A1 * | 8/2007 | Feng | H01Q 1/243 343/700 MS |
| 2008/0252530 | A1 | 10/2008 | Bae et al. | |
| 2009/0015497 | A1 * | 1/2009 | Nagumo | H01Q 1/243 343/750 |
| 2012/0013511 | A1 | 1/2012 | Sumi et al. | |
| 2012/0032866 | A1 * | 2/2012 | Chen | H01Q 9/42 343/846 |
| 2012/0127055 | A1 | 5/2012 | Yamagajo | |
| 2012/0146865 | A1 * | 6/2012 | Hayashi et al. | 343/750 |
| 2013/0099987 | A1 | 4/2013 | Desclos et al. | |
| 2013/0127674 | A1 * | 5/2013 | Korva | H01Q 1/243 343/702 |
| 2013/0154888 | A1 * | 6/2013 | Lin | H01Q 1/2266 343/745 |
| 2016/0079683 | A1 * | 3/2016 | Lee | H01Q 1/50 343/876 |

FOREIGN PATENT DOCUMENTS

| | | | |
|---|---|---|---|
| CN | 202585714 | U | 12/2012 |
| EP | 2458681 | A1 | 5/2012 |
| JP | 2001326521 | A | 11/2001 |
| JP | 2003283225 | A | 10/2003 |
| JP | 2003298329 | A | 10/2003 |
| JP | 2012109875 | A | 6/2012 |

OTHER PUBLICATIONS

Del Barrio, S.C., et al., "On the efficiency of frequency reconfigurable high-Q antennas for 4G standards," Electronics Letters, vol. 48, No. 16, Aug. 2, 2012, pp. 982-983. doi: 10.1049/el.2012.1315.

Bahramzy, P., et al., "Dual-feed ultra-compact reconfigurable handset antenna for penta-band operation," Antennas and Propagation Society International Symposium (APSURSI), IEEE. Jul. 11-17, 2010, pp. 1-4. doi: 10.1109/APS.2010.5562324.

Hossain, M.G.S., et al., "Reconfigurable printed antenna for a wideband tuning," 2010 Proceedings of the Fourth European Conference on Antennas and Propagation (EuCAP), Apr. 12-16, 2010, pp. 1-4.

International Search Report received in Application No. PCT/CN2014/084592, dated Nov. 26, 2014, 14 pages.

* cited by examiner

SYSTEM AND METHOD FOR A MOBILE ANTENNA WITH ADJUSTABLE RESONANT FREQUENCIES AND RADIATION PATTERN

TECHNICAL FIELD

The present invention relates to the field of antenna design for wireless communications, and, in particular embodiments, to a system and method for a mobile antenna with adjustable Resonant Frequencies and Radiation Pattern.

BACKGROUND

Recently, frequency spectrum for mobile communication has been widened significantly. However, antenna volume in mobile devices, such as smartphones and computer laptops/tablets, has not been increased to accommodate the widened bandwidth requirement. Typically, one frequency band is used at a time for communications at the mobile device. The device's antenna can be designed in such a way that it is adaptive to the frequency being used. At the mobile device, the resonant frequency of an antenna can be adjusted by the length of the antenna element as well as the coupling between the antenna element and the printed circuit board (PCB). However, due to limitation in available space for antenna design in mobile devices, the option of increasing the length of antenna is limited. Thus, there is a need for an efficient and relatively simple to implement antenna design and operation method to adjust or add frequency bands or communication frequencies at mobile devices using the available limited antenna volume or size.

SUMMARY OF THE INVENTION

In accordance with an embodiment, a method for providing adjustable frequency band at a wireless device includes electrically decoupling a radiator element from a first antenna and a second antenna of the wireless device to enable a low frequency band for the first antenna and a high frequency band for the second antenna. Upon determining to change the low frequency band or the high frequency band, the radiator element is electrically coupled to the first antenna and the second antenna to shift the low frequency band and the high frequency band.

In accordance with another embodiment, a method for providing adjustable frequency band at a wireless device includes, at the wireless device, closing a switch to electrically connect a radiator element to a circuit board connected to two antennas to shift frequency bands of the two antennas. Upon determining to shift back the frequency bands of the two antennas, the switch is opened to electrically disconnect the radiator element form the circuit board and the two antennas.

In accordance with another embodiment, an apparatus for a wireless communication device that supports adjustable frequency band for radio signals includes a circuit board, a first antenna connected to the circuit board via a first antenna feed, a second antenna connected to the circuit board via a second antenna feed, a radiator stub positioned onto the circuit board, wherein the radiator stub is disconnected from other elements of the circuit board and insulated from the first antenna and the second antenna, and a switch positioned between the radiator stub and the other elements of the circuit board and configured to electrically couple the radiator stub to the first antenna and the second antenna via the other elements of the circuit board, the first antenna feed, and the second antenna feed.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawing, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

System, method, and apparatus embodiments are provided herein for an efficient and relatively simple to implement antenna design and operation method to adjust or add frequency bands (or communication frequencies) at mobile devices using the available limited antenna volume or size. The embodiments include electrically coupling to the antenna elements at a mobile or radio device a tuning stub or element through a PCB (or a metal chassis). The PCB is placed between the antenna elements and the tuning stub and is connected to the antenna elements. The tuning stub can be positioned at a corner of the PCB, as shown below. The tuning stub can be connected/disconnected via a switch from the PCB, and hence the antenna elements, to shift the radiation of the antenna at different frequencies and also provide an additional mode (frequency) of radiation. The tuning stub can also be switched (connected/disconnected) to vary the radiation pattern of the antenna, as shown below.

Figure 1A:
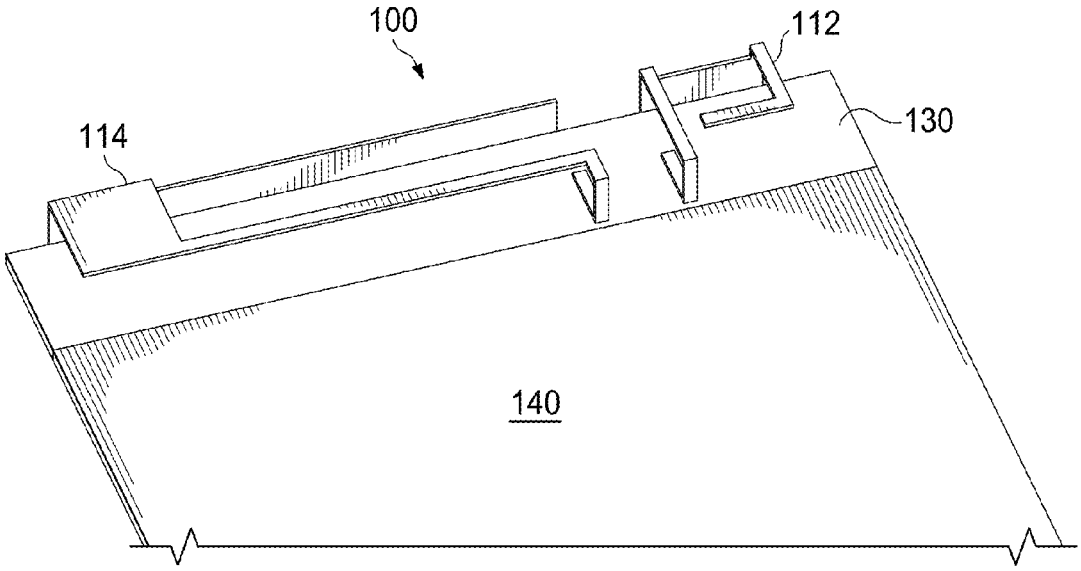
FIGS. 1A and 1B illustrate a 3D view of an embodiment of an antenna system design with adjustable resonant frequencies and radiation pattern.
Figure 1B:
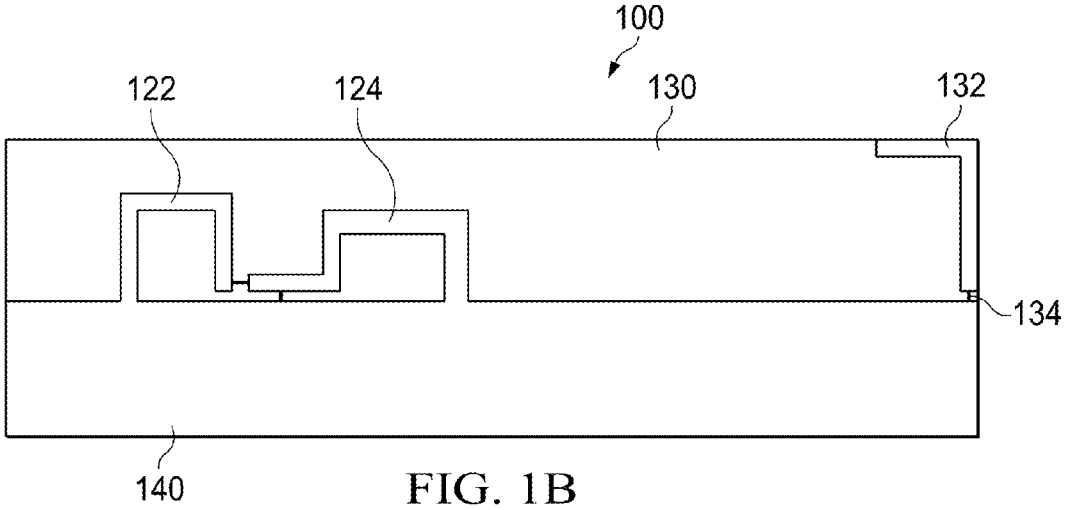

FIGS. 1A and 1B show an embodiment of an antenna system design 100 with adjustable resonant frequencies and radiation pattern. FIG. 1A shows a top surface of the antenna system design 100 and FIG. 1B shows a bottom surface at the opposite side of the antenna system design 100. The antenna system design 100 can be placed in a mobile or wireless communication device, for example, in a smartphone, a computer laptop, a computer tablet, a computer desktop, and other suitable devices. The antenna system design 100 includes a metal chassis or PCB 140 that can include various circuit components for antenna operation. The metal chassis or PCB 140 can also include other circuit components for the mobile device's operation. The components of the metal chassis or PCB 140 may be made from any suitable metal or conductor material. The components may be covered or laminated by a dielectric material. The metal chassis or PCB 140 may a have a rectangular shape or any other suitable shape that fits in the corresponding mobile device.

The antenna system design 100 also includes a high band antenna 112 and a low band antenna 114. The high band antenna 112 and low band antenna 114 are monopole antennas configured to operate in high frequency band and low frequency band, respectively. The two antenna sizes, lengths, and/or volumes can be designed according to predetermined high and low frequency bands. The predetermined high and low frequency bands can be chosen according to one or more service operators (e.g., cellular network providers) requirements. The high band antenna 112 and the low band antenna 114 have a three-dimensional (3D) design that can be optimized to operate at the corresponding pre-determined frequencies. Thus, the two antennas 112 and 114 may have different shapes, as shown in FIG. 1A. The antennas 112 and 114 are positioned on an insulator layer 130 on the top surface of the antenna system design 100, e.g., at one side of the metal chassis or PCB 140. The insulator layer 130 is made from any suitable dielectric that prevents direct electric coupling or contact of each of the two antennas 112 and 114 to the PCB on the top surface (FIG. 1A). However, the high band antenna 112 is coupled to the metal chassis or PCB 140 on the opposite side (bottom surface) of the antenna system design 100 via a high band feed 122, as shown in FIG. 1B. Similarly, the low band antenna 114 is coupled to the metal chassis or PCB 140 on the opposite side (bottom surface) of the antenna system design 100 via a low band feed 124. The antennas 112 and 114 and the respective feeds 122 and 124 are also made form a conducting material that may be the same or different than that of the components of the metal chassis or PCB 140.

Additionally, the antenna system design 100 includes a tuning stub 132 (also referred to herein as a radiator or coupling stub or element) that may be positioned on the bottom surface of the antenna system design 100. For example, the tuning stub 132 tuning stub can be placed at a corner of the bottom surface adjacent to the insulator layer 130 and the metal chassis or PCB 140. However, the tuning stub 132 is not in direct contact with the metal chassis or PCB 140. Instead, a switch 134 is positioned between the insulator layer 130 and the metal chassis or PCB 140 to connect or disconnect the tuning stub 132 and the metal chassis or PCB 140, and thus connect or disconnect the tuning stub 132 to the antennas 112 and 114 via the antenna feeds 122 and 124 via the metal chassis or PCB 140. The switch 134 can be a mechanical switch that is configured to connect or disconnect the tuning stub 132 to the metal chassis or PCB 140. Alternatively, switch 134 can be an electrical or electronic device switch, such as a diode, that is controlled, e.g., via bias voltage, to block or allow current flow between the tuning stub 132 and the metal chassis or PCB 140. Specifically, the switch 134 may be a two state switch, (e.g., an ON or OFF states), that either allows current flow between tuning stub 132 and the metal chassis or PCB 140 (ON state) or totally blocks the current flow between the two components (OFF state).

Connecting the tuning stub 132 to the antennas 112 and 114 allows electrical coupling or current flow between these components. The resulting change in the current flow path effectively or conceptually changes the antenna sizes or lengths, which causes changes in the radiation resonance or frequency mode for each of the two antennas 112 and 114. The changes in the radiation resonance may cause a shift of the entire operation band of the antenna system design 100, including a shift in the high frequency band of operation of the high band antenna 112 and a shift in the low frequency band of operation of the low band antenna 114. The changes in the radiation resonance can also add an extra frequency mode of operation (frequency band), for example above the high frequency band as shown below. Adding an extra frequency can be attributed to introducing a parasitic resonator effect due to coupling the tuning stub 132 to the antenna elements. The switch 134 can be turned ON to connect the tuning stub 132 to the antenna elements and thus shift the low and high frequency bands and add an additional or extra frequency band. Alternatively, the switch 134 can be turned OFF to disconnect the tuning stub 132 from the antenna elements and shift back the low and high frequency bands (and cancel the extra frequency). Further, switching the switch 134 ON and OFF can alter the radiation pattern, e.g., the direction and coverage area of incoming/outgoing radio signals, as shown below. When the switch is ON (connected tuning stub 132 and antenna elements), the frequency bands radiate in a different pattern than when the switch 134 is OFF (disconnected tuning stub 132 and antenna elements). In other embodiments, other designs that include two monopole antennas, a switch, and a tuning stub can also be used for adjusting the frequencies (shifting and adding) and the radiation patterns of the antenna system.

Figure 2:
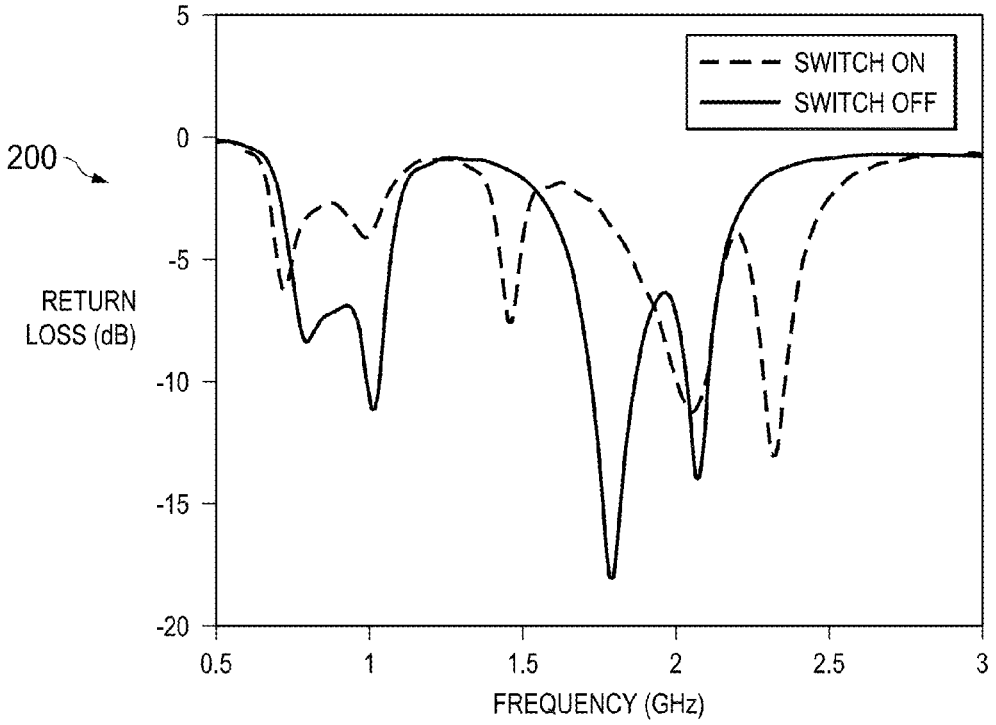
FIG. 2 is a chart that illustrates changes in resonant frequencies achieved by an antenna design according to an embodiment of the disclosure.

FIG. 2 shows a chart 200 illustrating changes in resonant frequencies achieved by an antenna design as described above. For instance, the antenna system design 100 can have resonant frequencies similar to those shown in chart 200. The chart 200 includes two curves of return loss (in DB) vs. frequency (in GHz) that correspond to turning the switch (e.g., switch 134) OFF and ON. When the switch is OFF, the tuning stub radiation effect is cancelled (the tuning sub is disconnected from the antenna elements). The dip in the return loss for the low frequency band is around 0.8 GHz. The dip in the return loss for the high frequency band is around 1.7 GHz. By turning the switch ON (the tuning sub is connected to the antenna elements), the spectrum is shifted causing a shift in the dip in the low frequency band (to around 0.7 GHz) as well the high frequency band (to around 1.5 GHz). An extra frequency band is also added at around 2 GHz when the switch is ON.

Figure 3:
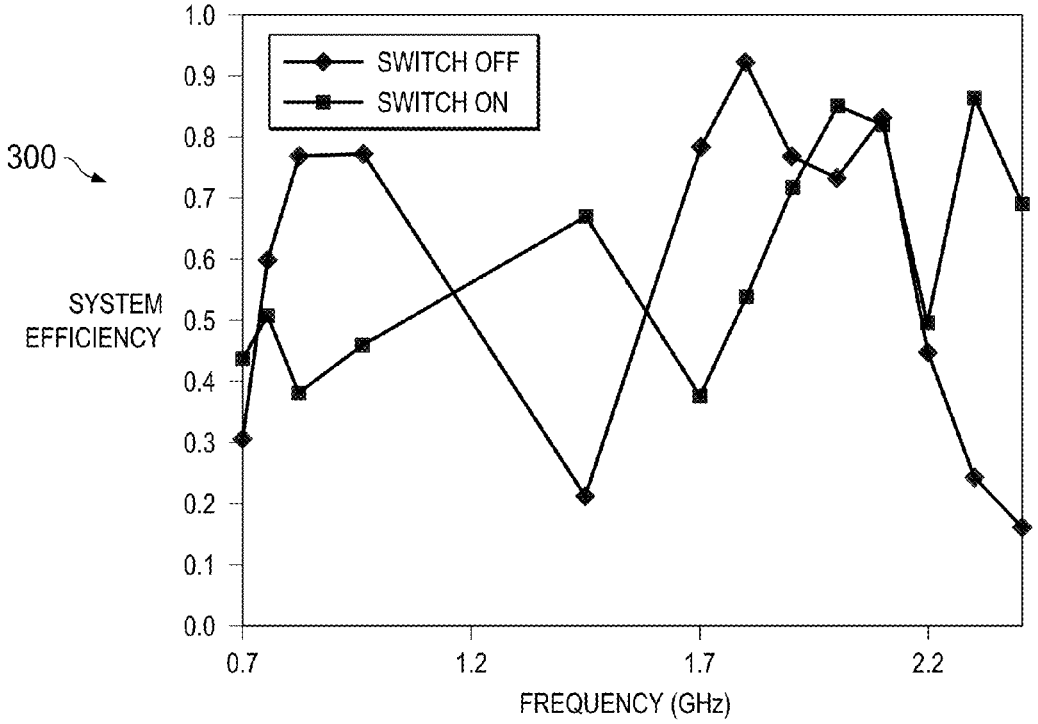
FIG. 3 is a chart that illustrates changes in antenna output efficiency by the antenna design of FIG. 2.

FIG. 3 shows a chart 200 illustrating changes in output efficiency of resonant frequencies that can be achieved by the antenna design of FIG. 2. The chart 300 includes two curves of output efficiency (ratio of output radiation power to input power in DB) vs. frequency (in GHz) that correspond to the two curves in FIG. 2 when the switch is turned OFF and ON. When the switch is OFF, the tuning stub radiation effect is cancelled (the tuning sub is disconnected from the antenna elements). The peak in the efficiency for the low frequency band is around 0.8 GHz. The peak in the efficiency for the high frequency band is around 1.7 GHz. By turning the switch ON (the tuning sub is connected to the antenna elements), the spectrum is shifted causing a shift in the peak in the low frequency band (to around 0.7 GHz) as well as the high frequency band (to around 1.5 GHz). An extra frequency band is also added at around 2 GHz due to the parasitic resonator effect introduced by the tuning or coupling stub to the antennas.

Figure 4:
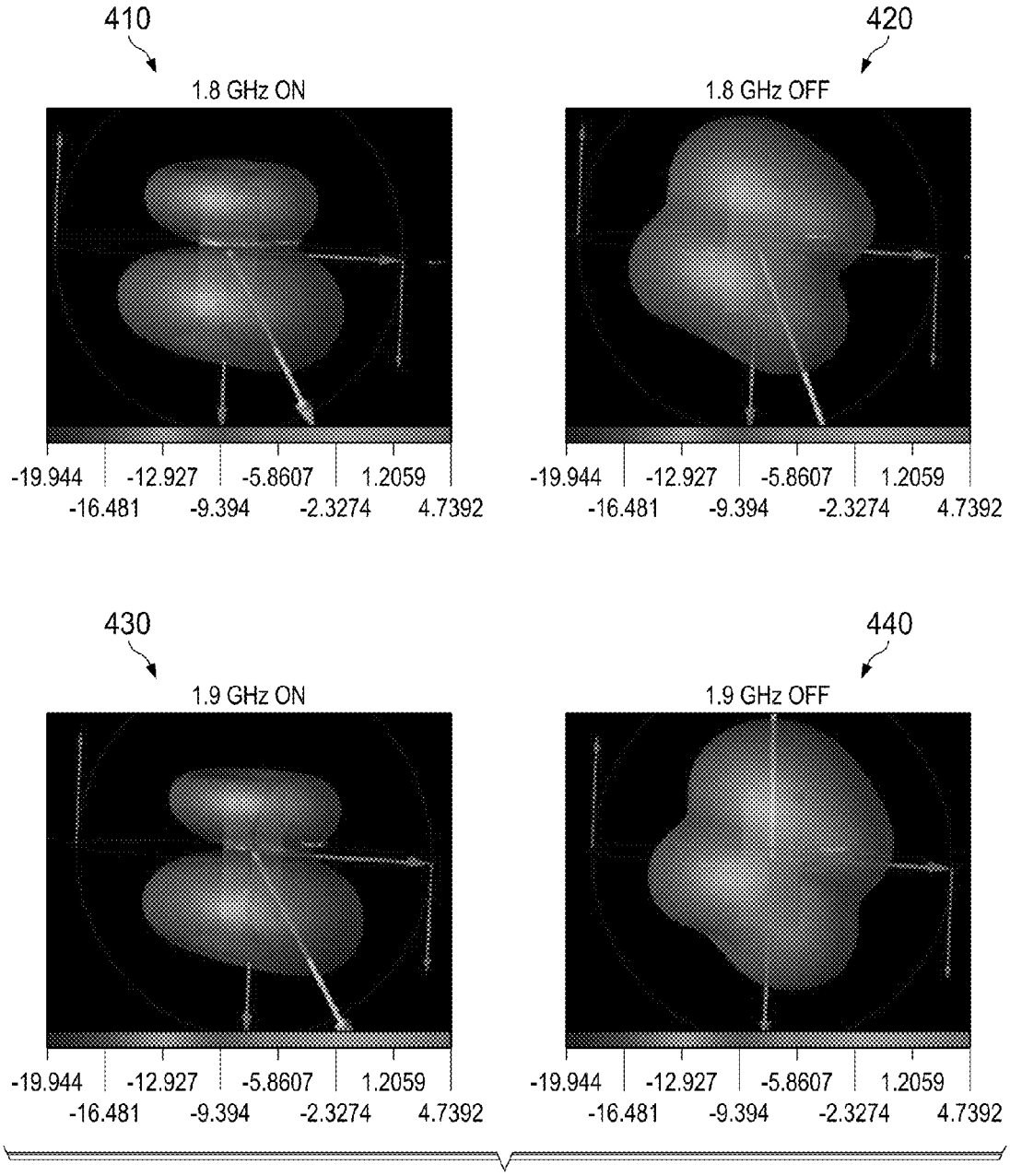
FIG. 4 illustrates changes in radiation pattern achieved by an antenna design according to an embodiment of the disclosure.

FIG. 4 shows different radiation patterns 410, 420, 430, and 440 that illustrate changes in radiation pattern, which can be achieved by an antenna design as described above (e.g., as the antenna system design 100). The switch of the tuning stub is switched ON or OFF to change the radiation pattern at a given frequency. The radiation pattern 410 corresponds to a band frequency (at 1.8 GHz) when the switch is ON and the tuning or radiator stub is electrically coupled to the antenna elements. Alternatively, the radiation pattern 420 corresponds to the same band frequency when the switch is OFF and the tuning or radiator stub is electrically decoupled from the antenna elements. The radiation pattern 430 corresponds to another band frequency (at 1.9 GHz) when the switch is ON to couple the tuning or radiator stub to the antenna elements. Alternatively, the radiation pattern 440 is obtained for that frequency when the switch is OFF.

Figure 5:
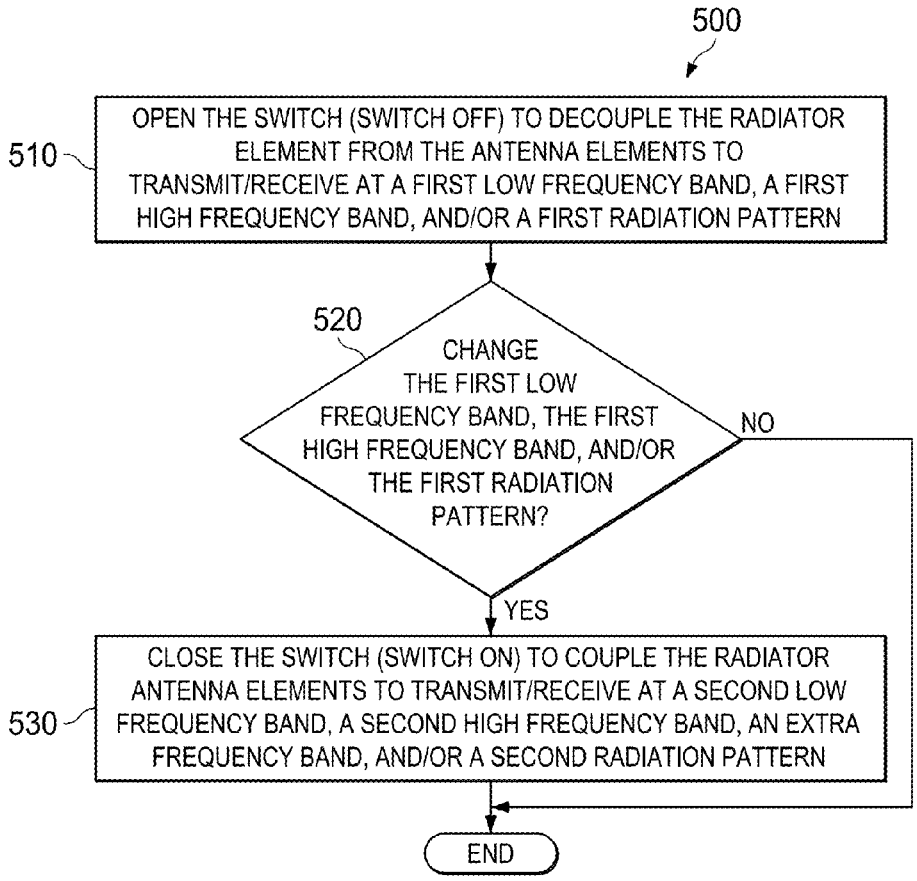
FIG. 5 is a flowchart that illustrates an operation method for an antenna design with adjustable resonant frequencies and radiation pattern.

FIG. 5 shows an embodiment of an operation method 500 for an antenna design with adjustable resonant frequencies and radiation pattern. For instance, the operation method 500 can be implemented by a mobile or wireless communication device including the antenna system design 100 to send/receive wireless or radio signals. At step 510 of the method 500, the switch is opened (or switched OFF) to decouple the tuning or radiator stub or element from the antenna elements to transmit/receive at a first low frequency band, a first high frequency band, and/or a first radiation pattern. At step 520, the method 500 determines whether a change to the first low frequency band, the first high frequency band, and/or the first radiation pattern is needed to transmit/receive signals of the device. For example, a change of the first low frequency band or first high frequency band may be needed when the device is in roaming and changes operator network. If the condition in step 510 is detected, then the method proceeds to step 520. Otherwise, the method 500 ends. At step 530, the switch is closed (or in ON mode) to couple the tuning or radiator stub to the antenna elements to transmit/receive at a second low frequency band, a second high frequency band, an extra frequency band, and/or a second radiation pattern.

Figure 6:
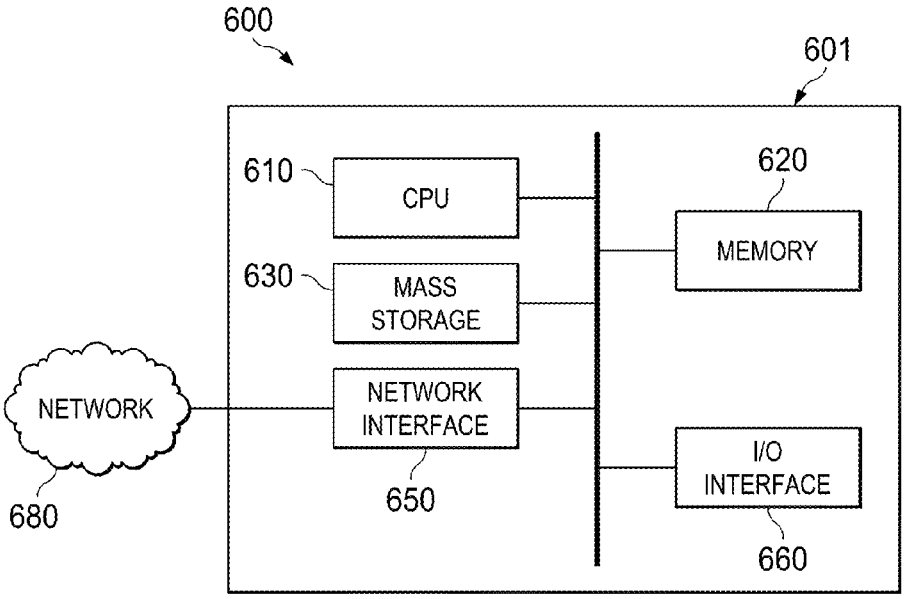
FIG. 6 is a diagram of an exemplary processing system that can be used to implement various embodiments.

FIG. 6 is a block diagram of an exemplary processing system 600 that can be used to implement various embodiments. Specific devices may utilize all of the components shown, or only a subset of the components and levels of integration may vary from device to device. Furthermore, a device may contain multiple instances of a component, such as multiple processing units, processors, memories, transmitters, receivers, etc. The processing system 600 may comprise a processing unit 601 equipped with one or more input/output devices, such as a network interfaces, storage interfaces, and the like. The processing unit 601 may include a central processing unit (CPU) 610, a memory 620, a mass storage device 630, and an I/O interface 660 connected to a bus. The bus may be one or more of any type of several bus architectures including a memory bus or memory controller, a peripheral bus or the like.

The CPU 610 may comprise any type of electronic data processor. The memory 620 may comprise any type of system memory such as static random access memory (SRAM), dynamic random access memory (DRAM), synchronous DRAM (SDRAM), read-only memory (ROM), a combination thereof, or the like. In an embodiment, the memory 620 may include ROM for use at boot-up, and DRAM for program and data storage for use while executing programs. In embodiments, the memory 620 is non-transitory. The mass storage device 630 may comprise any type of storage device configured to store data, programs, and other information and to make the data, programs, and other information accessible via the bus. The mass storage device 630 may comprise, for example, one or more of a solid state drive, hard disk drive, a magnetic disk drive, an optical disk drive, or the like.

The processing unit 601 also includes one or more network interfaces 650, which may comprise wired links, such as an Ethernet cable or the like, and/or wireless links to access nodes or one or more networks 680. The network interface 650 allows the processing unit 601 to communicate with remote units via the networks 680. For example, the network interface 650 may provide wireless communication via one or more transmitters/transmit antennas and one or more receivers/receive antennas. In an embodiment, the processing unit 601 is coupled to a local-area network or a wide-area network for data processing and communications with remote devices, such as other processing units, the Internet, remote storage facilities, or the like.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

What is claimed is:

1. A method for providing adjustable frequency bands at a wireless device, the method comprising:

electrically disconnecting a radiator element from a first antenna and a second antenna of the wireless device using a switch, the first antenna, the second antenna and the radiator element being separate from one another, wherein the first antenna is connected to a circuit board through a first antenna feed, and the second antenna is connected to the circuit board through a second antenna feed that is separate from the first antenna feed, the second antenna being connected to the circuit board without going through the first antenna feed, wherein the radiator element is electrically disconnected from the circuit board, wherein a low frequency band is emitted by the first antenna and a high frequency band is emitted by the second antenna; and electrically connecting the radiator element to both the first antenna and the second antenna using the switch, wherein the radiator element is electrically connected to the circuit board such that electric current flows between the radiator element and each of the first antenna and the second antenna, wherein the radiator element is electrically connected to both the first antenna and the second antenna to shift the low frequency band of the first antenna and the high frequency band of the second antenna, and change a resonant frequency of each of the first antenna and the second antenna, wherein the radiator element, the first antenna feed and the second antenna feed are positioned on a first surface of the circuit board, wherein the first antenna and the second antenna are positioned on a second surface of the circuit board that faces in an opposite direction from the first surface of the circuit board, and wherein the first antenna feed and the second antenna feed extend along an edge of a metal plane on the circuit board.

2. The method of claim 1, wherein the radiator element is electrically connected to and disconnected from the first antenna and the second antenna using a switch, and wherein the switch is set to an ON state for current to flow between the radiator element and each of the first antenna and the second antenna or set to an OFF state to prevent current flow between the radiator element and each of the first antenna and the second antenna.

3. The method of claim 2, wherein the switch is an electrical switch that is set on to electrically connect the radiator element to the first antenna and the second antenna and allow current flow between the radiator element and each of the first antenna and the second antenna or is set off to electrically disconnect the radiator element from the first antenna and the second antenna and prevent current flow between the radiator element and each of the first antenna and the second antenna.

4. The method of claim 2, wherein the switch is an electrical or electronic device switch that is controlled by suitable input voltage to electrically connect the radiator element to or electrically disconnect the radiator element from the first antenna and the second antenna to allow or block current flow between the radiator element and each of the first antenna and the second antenna.

5. The method of claim 1 further comprising electrically connecting the radiator element to the first antenna and the second antenna to add an extra frequency band for the wireless device, wherein the extra frequency band results from a parasitic resonator effect of the radiator element to the first antenna and the second antenna.

6. The method of claim 1 further comprising electrically disconnecting the radiator element from the first antenna and the second antenna to establish a first radiation pattern for any of the first antenna and the second antenna or electrically connecting the radiator element to the first antenna and the second antenna to change the first radiation pattern to a second radiation pattern.

7. A method for providing adjustable frequency bands at a wireless device, the method comprising:

at the wireless device, setting on a switch to electrically connect a radiator element to each of two antennas to simultaneously shift frequency bands of the two antennas, wherein the radiator element is electrically connected to a circuit board, and each of the two antennas is electrically connected to the circuit board via respective antenna feeds, one of the two antennas being electrically connected to the circuit board without going through an the antenna feed of the other one of the two antennas, wherein the radiator element and the two antennas are separate from one another, the radiator element and the antenna feeds of the two antennas being positioned on a first surface of the circuit board, and the two antennas being positioned on a second surface of the circuit board that faces in an opposite direction from the first surface of the circuit board, wherein setting on the switch allows electric current to flow between the radiator element and each of the two antennas and changes a resonant frequency of each of the two antennas, wherein the two antennas operate at different frequency bands, and wherein the antenna feeds of the two antennas extend along an edge of a metal plane on the circuit board; and upon determining to shift back the frequency bands of the two antennas, setting off the switch to electrically disconnect the radiator element from the circuit board and the two antennas.

8. The method of claim 7, further comprising:

setting on the switch to change an initial radiation pattern of any of the two antennas; and upon determining to recover the initial radiation pattern, setting off the switch.

9. The method of claim 7, further comprising setting on the switch to add an extra frequency band to operate the two antennas or setting off the switch to cancel the extra frequency band.

10. The method of claim 9, wherein the frequency bands of the two antennas include a low frequency band and a high frequency band, and wherein the extra frequency band is around 2.2 Gigahertz and is above the low frequency band and the high frequency band.

11. The method of claim 9, wherein the extra frequency band is added by introducing a parasitic resonator effect of the radiator element into the two antennas.

12. The method of claim 7, wherein the shift in frequency bands of the two antennas is introduced by causing current flow between the radiator element and the two antennas and thus altering current flow paths in the two antennas.

13. The method of claim 7, wherein the shift in frequency bands of the two antennas includes a shift in a low frequency band around 1 Gigahertz and a shift in a high frequency band around 2 Gigahertz.

14. An apparatus for a wireless communication device, the apparatus supporting adjustable frequency bands for radio signals and comprising:

a circuit board;

a first antenna connected to the circuit board via a first antenna feed, the first antenna adapted to emit a low frequency band;

a second antenna connected to the circuit board via a second antenna feed that is separate from the first antenna feed, the second antenna being connected to the circuit board without going through the first antenna feed, and the second antenna adapted to emit a high frequency band;

a radiator stub positioned on the circuit board, wherein the radiator stub is insulated from the first antenna and the second antenna, the radiator stub, the first antenna and the second antenna are separate from one another; and a switch configured to electrically connect the radiator stub to both the first antenna and the second antenna via the circuit board, the first antenna feed, and the second antenna feed to simultaneously shift the low frequency band of the first antenna and the high frequency band of the second antenna, wherein the switch electrically connects the radiator stub to both the first antenna and the second antenna for electric current to flow between the radiator stub and each of the first antenna and the second antenna and to change a resonant frequency of each of the first antenna and the second antenna, wherein the radiator stub, the first antenna feed and the second antenna feed are positioned on a first surface of the circuit board, wherein the first antenna and the second antenna are positioned on a second surface of the circuit board that faces in an opposite direction from the first surface of the circuit board, and wherein the first antenna feed and the second antenna feed extend along an edge of a metal plane on the circuit board.

15. The apparatus of claim 14, wherein the switch is an electrical switch configured to be set on to electrically connect the radiator stub and the circuit board to allow current flow between the radiator stub and each of the first antenna and the second antenna and is configured to be set off to disconnect the radiator stub from the circuit board to prevent current flow between the radiator stub and each of the first antenna and the second antenna.

16. The apparatus of claim 14, wherein the switch is a diode or other electronic switching device configured, via voltage input, to electrically connect or disconnect the radiator stub and the circuit board to allow or block current flow between the radiator stub and each of the first antenna and the second antenna.

17. The apparatus of claim 14, wherein the first antenna and the second antenna are monopole antennas.

18. The apparatus of claim 14, wherein the first antenna and the second antenna have different sizes, lengths, volumes, or three-dimensional shapes.

19. The apparatus of claim 14, wherein the radiator stub is positioned at a corner of the circuit board.

20. The apparatus of claim 14, wherein the first antenna feed and the second antenna feed are insulated from the radiator stub on the first surface of the circuit board.

21. An antenna supporting adjustable frequency bands for radio signals, the antenna comprising:

a first antenna element connected to a circuit board via a first antenna feed, the first antenna element adapted to emit a low frequency band;

a second antenna element connected to the circuit board via a second antenna feed that is separate from the first antenna feed, the second antenna element being connected to the circuit board without going through the first antenna feed, and the second antenna element adapted to emit a high frequency band;

a frequency tuning element insulated from the first antenna element and the second antenna element, the frequency tuning element, the first antenna element and the second antenna element are separate and independent from one another; and a switch positioned between the frequency tuning element and the circuit board and configured to electrically connect the frequency tuning element to both the first antenna element and the second antenna element via the circuit board, the first antenna feed, and the second antenna feed to simultaneously shift the low frequency band of the first antenna element and the high frequency band of the second antenna element, wherein the switch electrically connects the frequency tuning element to both the first antenna element and the second antenna element to allow electric current to flow between the frequency tuning element and the first antenna element and between the frequency tuning element and the second antenna element, and to change a resonant frequency of each of the first antenna element and the second antenna element, wherein the frequency tuning element, the first antenna feed and the second antenna feed are positioned on a first surface of a circuit board, wherein the first antenna element and the second antenna element are positioned on a second surface of the circuit board that faces in an opposite direction from the first surface of the circuit board, and wherein the first antenna feed and the second antenna feed extend along one edge of a metal plane on the circuit board.

22. The antenna of claim 21, wherein the switch is adjustable to electrically connect the frequency tuning element and the circuit board and allow current flow between the frequency tuning element and each of the first antenna element and the second antenna element, or to electrically disconnect the frequency tuning element from the circuit board and prevent current flow between the frequency tuning element and each of the first antenna element and the second antenna element.

23. The antenna of claim 21, wherein the frequency tuning element is insulated from the circuit board, and wherein the switch is adjustable to connect or disconnect the frequency tuning element to the circuit board.

* * * * *